United States Patent [19]

Williamson et al.

[11] 3,998,173

[45] Dec. 21, 1976

[54] STITCHED WIRE ELECTRICAL STRUCTURE AND METHOD OF MAKING SAME

[75] Inventors: Clyde E. Williamson, Torrance; Irvin G. Aker, El Segundo, both of Calif.

[73] Assignee: TRW Inc., Redondo Beach, Calif.

[22] Filed: Dec. 9, 1974

[21] Appl. No.: 530,909

[52] U.S. Cl. ..... 112/262; 112/440; 343/897

[51] Int. Cl.[2] ..... D05B 1/00; H01Q 1/36

[58] Field of Search ..... 112/262, 2, 54, 265, 112/412, 415, 416, 417, 420, 429, 432, 440; 29/600; 140/93; 343/881, 897

[56] References Cited

UNITED STATES PATENTS

| | | | |
|---|---|---|---|
| 668,684 | 2/1901 | Kelly | 112/420 |
| 3,135,935 | 6/1964 | Engelbrecht | 112/440 X |
| 3,165,817 | 1/1965 | Teague | 29/600 |

FOREIGN PATENTS OR APPLICATIONS

| | | | |
|---|---|---|---|
| 516,263 | 12/1939 | United Kingdom | 343/897 |
| 227,604 | 1/1925 | United Kingdom | 343/897 |

*Primary Examiner*—Werner H. Schroeder
*Assistant Examiner*—Peter Nerbun
*Attorney, Agent, or Firm*—Daniel T. Anderson; Donald R. Nyhagen; Jerry A. Dinardo

[57] ABSTRACT

An electrical structure having a wire conductor secured to a supporting substrate is fabricated by stitching the substrate with a sewing machine using a wire as one sewing filament of the machine. The particular electrical structure described is a parabolic antenna having a wire screen reflector consisting of a plurality of wire screen sections or "squares" secured in checkerboard fashion to a supporting frame with the edges of adjacent squares in electrical contact. Each square is fabricated by utilizing the wire stitching technique of the invention to lock stitch a supporting substrate in a grid pattern consisting of the stitched wires disposed in intersecting parallel rows and electrically joined to one another at their intersections to form a screen square.

13 Claims, 9 Drawing Figures

STITCHED WIRE ELECTRICAL STRUCTURE AND METHOD OF MAKING SAME

RELATED APPLICATION

Reference is made to copending application Ser. No. 363,220, filed May 23, 1973 entitled "Collapsible Self-Erecting Tubular Frame Structure and Deployable Electromagnetic Reflector Embodying Same."

BACKGROUND OF THE INVENTION

1. Field of the Invention

This invention relates generally to electrical structures of the class which comprise one or more wire conductors attached to a supporting substrate or the like. More particularly, the invention relates to such structures and their method of fabrication wherein the wires are stitched to the substrate. The invention relates also to a parabolic antenna having a wire screen reflector fabricated by the stitching technique.

2. Prior Art

As will appear from the ensuing description, the wire stitching method of the invention may be employed to fabricate a variety of electrical structures of the class described. One useful application of the invention involves the fabrication of a wire mesh or screen structure for use as an antenna reflector. The invention will be described in this context.

One well known form of directional communication antenna has a parabolic radiation reflector and a feed horn at the focus of the reflector. In the transmitting mode of such an antenna, electromagnetic radiation emanates rearwardly from the horn toward the reflector and is then reflected forward from the reflector in the form of a radiation beam. In the receiving mode of the antenna, incoming radiation incident on the reflector is reflected forwardly toward the feed horn in the form of a convergent beam which is focussed at the horn.

The reflectors for such antennas assume various forms. Some reflectors, for example, are rigid parabolic dishes. Other reflectors comprise rigid parabolic sections which are supported for movement between a compact contracted configuration and a deployed parabolic dish configuration. Yet other reflectors comprise a flexible sheet or sheet-like electromagnetically reflective material and a supporting frame which may be folded or otherwise deformed to a compact contracted configuration and unfolded to deployed parabolic dish configuration. In some cases, the foldable reflective material comprises a wire mesh or screen. An antenna reflector of this latter kind is disclosed in the copending application mentioned earlier.

Fabrication of such a wire mesh or wire screen antenna presents one problem with which this invention is concerned. The problem referred to involves attachment of the wire screen to its supporting frame. According to one of its more limited aspects, this invention provides a novel wire screen antenna reflector of this kind and a novel method of fabricating the reflector. As will appear from the ensuing description, this fabricating method involves a novel method of attaching wires to a supporting substrate or the like. A broader aspect of the invention is concerned with this attaching method per se.

SUMMARY OF THE INVENTION

According to its broader aspects, the invention provides a method of attaching a wire conductor to a supporting substrate or the like by stitching the wire to the substrate. This is accomplished with the aid of a sewing machine which sews preferably with a lock stitch, using a bobbin filament and a spool filament. A wire is used as one of these filaments, preferably the bobbin filament. The supporting substrate is stitched in the usual manner with the tension of the bobbin adjusted so that the wire filament lies flat along the substrate surface and is attached to the substrate at intervals by the second sewing machine filament.

The invention is described in connection with the fabrication of a parabolic antenna having a collapsible strain energy deployable supporting frame similar to that of the earlier mentioned copending application. This frame is constructed of thin-walled, deformable plastic tubes or beams joined in a truss-like array to form a frame structure having a front side conforming closely to a parabolic surface. This front frame side or surface is defined by a multiplicity of the plastic beams arranged in a rectangular grid-like pattern forming a rectangular array of rectangular openings each bounded along its four sides by four plastic beams. The beams are constructed of resilient plastic, such as MYLAR or KAPTON, and are preformed to a tubular shape, such that the frame may be folded to a compact stowage configuration in which the deformed beams store elastic strain energy for erecting or deploying the frame to its normal configuration when released.

Attached to the front parabolic surface of the frame is a wire mesh or screen which conforms substantially to the parabolic curvature of the frame surface. According to another aspect of the invention, this screen is constructed in a plurality of separate sections or squares each overlying one of the rectangular openings in the frame surface. The edges of each square overlap the four beams about the respective opening and the adjacent edges of the grid squares overlying the adjacent openings. The overlapping edges of the squares are electrically and mechanically joined to one another and are attached to the underlying frame beams. In the particular embodiment described, the overlapping grid edges are secured to the beam by welding or brazing the edges to wires stitched into the beams.

The individual grid squares are fabricated by securing a substrate such as a dielectric mesh to a rectangular grid square support frame, hereafter referred to simply as a support frame, having a rectangular opening larger than the rectangular openings in the parabolic surface of the antenna frame, such that the support frame may be placed in a position over the antenna frame wherein the grid frame opening is aligned with an antenna frame opening with the beams about the latter opening exposed through the support frame opening. The substrate is then stitched with a wire in a grid pattern after which the stitched wires are joined at their intersections to form a wire grid screen. If desired, a pattern which is marked to indicate the stitch lines may be provided on the substrate. The grid frame with its stitched substrate is placed over a selected opening in the antenna frame and the substrate and its stitched screen are secured to the adjacent antenna frame beams. The support frame is then removed and the substrate and screen are trimmed off flush with the beams.

DESCRIPTION OF THE PREFERRED EMBODIMENT

Figure 9:
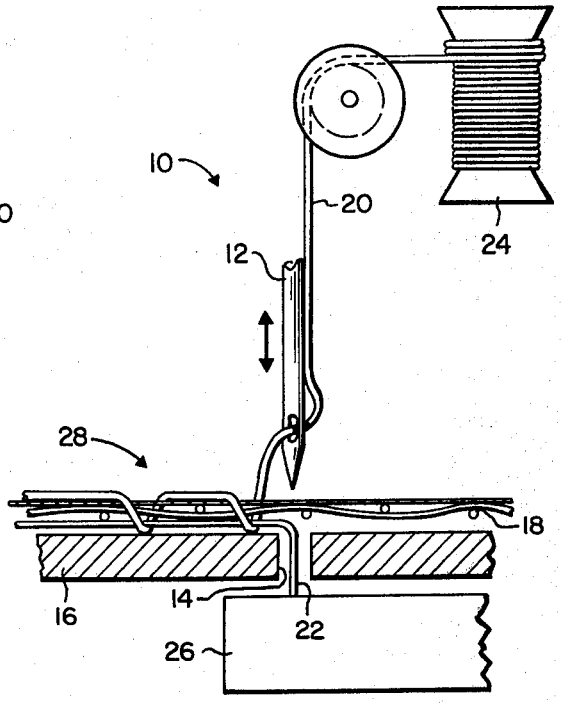
FIG. 9 illustrates a stitching operation involved in fabrication of the assembly.
Figure 6:
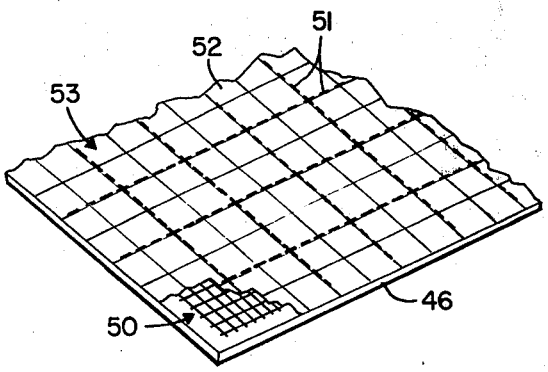
FIG. 6 is an enlarged fragmentary perspective view of one side of the assembly in FIG. 5.
Figure 7:
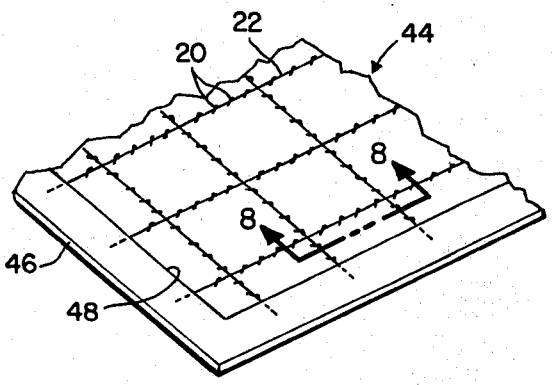
FIG. 7 is an enlarged fragmentary perspective view of the other side of the assembly.
Figure 8:
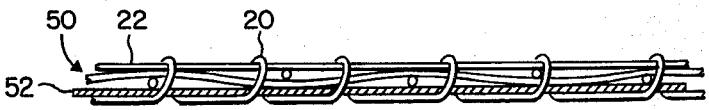
FIG. 8 is an enlarged section taken on line 8—8 in FIG. 7.

As noted earlier, one aspect of the invention is concerned with attaching a wire to a supporting substrate by a stitching operation. FIG. 9 diagrammatically illustrates this stitching operation. In this figure, reference numeral 10 denotes a conventional sewing machine capable of sewing or stitching with a lock stitch. The sewing machine has a needle 12 which is driven in a vertical reciprocating motion into and from an opening 14 in a horizontal table 16. The substrate 18 to be stitched is moved across this table below the needle.

The sewing machine 10 uses two sewing filaments, a spool filament 20 and a bobbin filament 22. Spool filament 20 is wound on a spool 24 and passes through the eye of the needle 12. The bobbin filament is wound in a bobbin located within a holder 26 below the table 16.

The stitching operation of the sewing machine 10 is well understood and hence need not be explained in elaborate detail. Suffice it to say that in the course of this machine operation, the needle 12 periodically penetrates the substrate 18 as the latter is fed edgewise across the table 16 past the needle in such a way that the substrate is formed with the lock stitching 28. The bobbin tension is so adjusted that the bobbin filament 22 lies flat against the underside of the substrate and the spool filament 20 passes through the substrate and around the bobbin filament at intervals along the latter to secure the bobbin filament to the substrate.

According to the present method of stitching a wire, a thin wire strand is used as one of the sewing filaments 20, 22. According to the preferred practice of the invention, the wire filament is the bobbin filament.

Another aspect of the invention, which utilizes the wire stitching technique described above, involves the parabolic antenna 30 of FIGS. 1–8 and its method of fabrication. Antenna 30, which, though rectangular in shape, is referred to herein in places as an antenna "dish", has a supporting frame 32 with a front side 34 which conforms generally to a parabolic surface. Secured to and conforming to the parabolic curvature of the front frame surface is a wire mesh or wire grid 36 which forms the electromagnetic reflector of the antenna.

Figure 4:
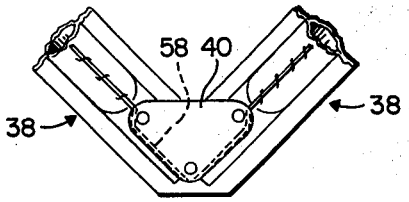
FIG. 4 is an enlarged framentary perspective view of a beam joint embodied in the antenna frame.
Figure 5:
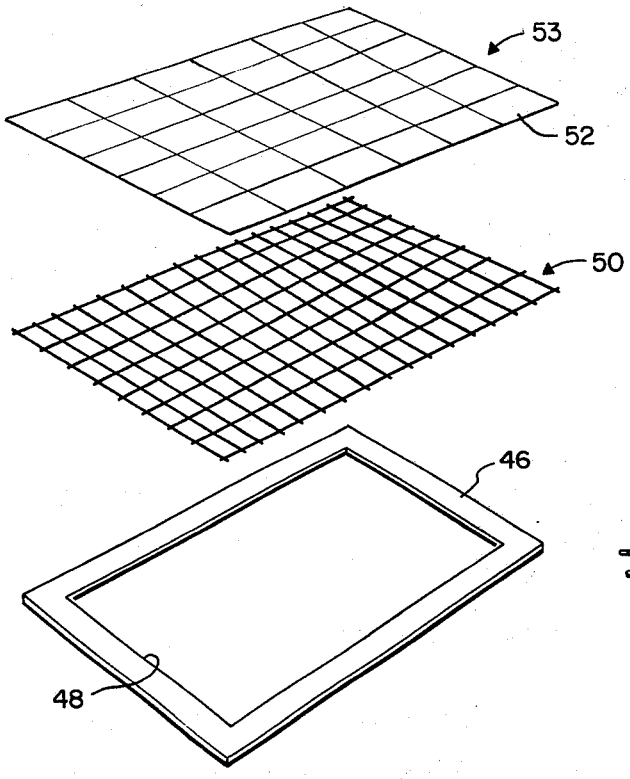
FIG. 5 is an exploded perspective view of a wire grid square assembly which is utilized in the fabrication of the antenna reflector.

While the antenna frame 32 may be a rigid frame structure, the particular frame shown is a collapsible strain energy deployable truss frame similar to that disclosed in the earlier mentioned copending application. This frame is constructed of truss members 38 in the form of thin flexible plastic tubular beams having the flanged cross-section shown in FIG. 2. These beams may be flattened and folded to a collapsed configuration wherein they store elastic strain energy which restores the beams to their tubular shape when released. The beams are joined to one another in any convenient manner as by means of connecting plates 40, as shown in FIG. 4.

Antenna frame 32 has a truss frame construction, the front parabolic side 34 of which has a plurality of rectangular openings 42 arranged in checkerboard fashion and each bounded by four of the frame beams 38. According to the present invention, the antenna screen reflector 36 comprises a plurality of individual sections or squares 44 each overlying one of the frame openings 42. Each screen square overlaps the adjacent frame beams 38 and the edges of the adjacent frame. The overlapping edges of the adjacent screen squares are electrically and mechanically joined to one another and to the underlying antenna frame beams. Another aspect of the invention is concerned with a unique method of fabricating the screen squares 44 and securing the latter to the antenna frame 32. According to this aspect of the invention, each square is fabricated with the aid of a rectangular support frame 46 having a rectangular opening 48 and adapted to be placed over one of the antenna frame openings 42, as shown in broken lines in FIG. 1 and described below. The support frame opening 48 is so sized that when the frame is placed over an antenna frame opening, the four beams 38 bounding the latter opening are exposed through the support frame opening, as shown in FIG. 1.

A supporting substrate 50 is secured to the support frame 46 with the substrate extending across the frame opening 48. It is possible within the scope of the invention to use a variety of substrate materials, as will become readily evident from the ensuing description. The particular substrate shown is a net constructed of plastic strands, i.e., a "fish net-like" substrate, having a grid size smaller than that of the wire screen 36. The screen square 44 is formed by stitching the substrate along intersecting rows 51 forming a grid pattern using the wire stitching technique described earlier in connection with FIG. 9, such that the wire sewing filaments 22 lie flat against the underside of the net substrate in a wire grid or screen arrangement. The crossing wires are then brazed, welded or otherwise electrically joined to one another at their intersections to form a wire screen square 44.

According to the preferred practice of the invention, a pattern sheet 52 of scrim paper or the like is secured to the support frame 46 over the net substrate 50. This pattern sheet is marked with a grid pattern 53 conforming to the desired grid pattern of the stitched wire screen square 44. The substrate and pattern sheet 52 are stitched along the lines of this grid pattern to form the screen square, after which the pattern sheet is removed. Removal of the pattern sheet is made easy by the fact that the stitching perforates the sheet, providing tear lines along which the sheet readily parts when pulled. After removal of the pattern sheet there remains a screen assembly 54 consisting of the support frame 46, net substrate 50, and stitched screen square 44 on the substrate. One of these screen assemblies is prepared for each opening 42 of the antenna frame 32.

Figure 1:
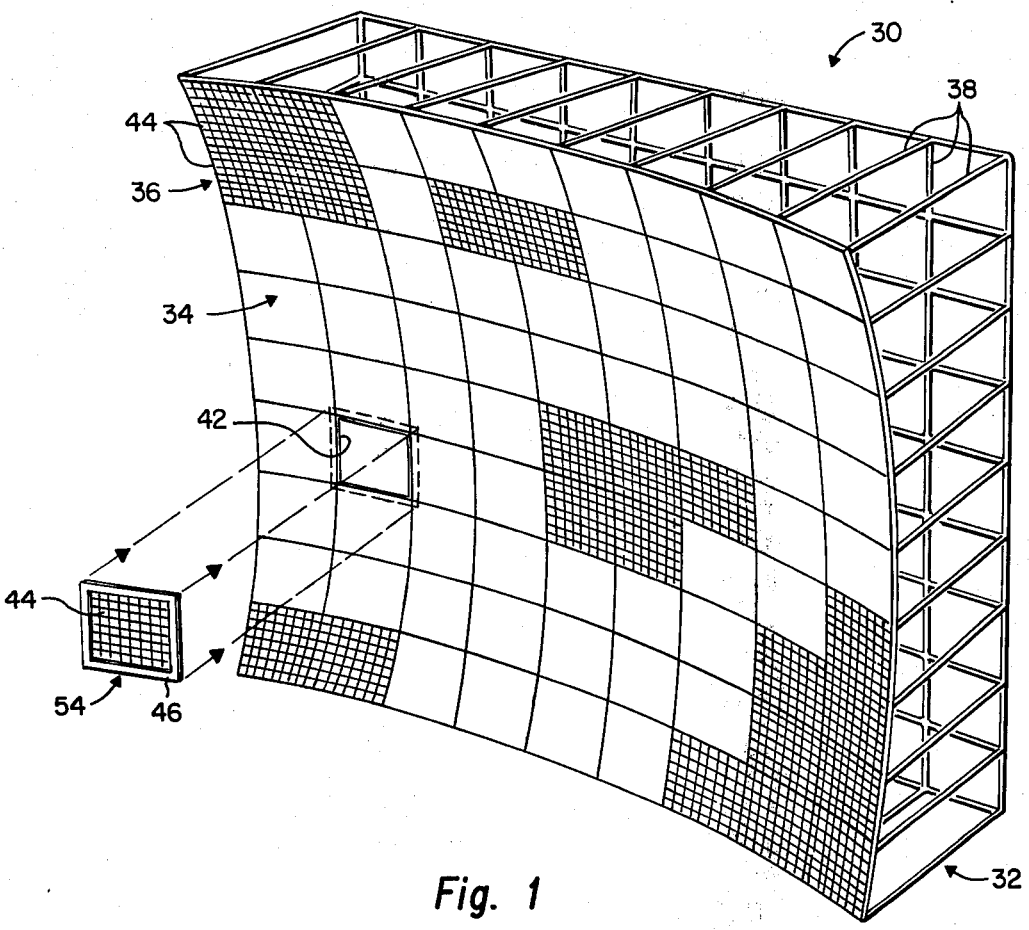
FIG. 1 is a perspective view of a parabolic antenna embodying a wire mesh or wire screen electromagnetic reflector according to the invention.
Figure 2:
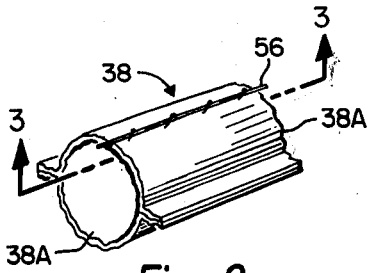
FIG. 2 is an enlarged fragmentary perspective view of a tubular plastic beam embodied in the antenna frame.
Figure 3:
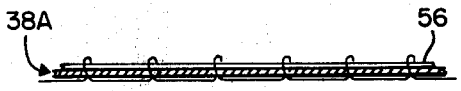
FIG. 3 is an enlarged section taken on line 3—3 in FIG. 2.

The screen square 44 and substrate 50 of each screen assembly 54 are secured to the antenna frame 32 by placing the assembly over the respective frame opening 42, as indicated in broken lines in FIG. 1. From the earlier discussion of the size of the support frame 46, it will be understood that when the screen assembly is thus placed against the antenna frame, the edges of the assembly screen 44 and substrate overlap the four beams 38 of the antenna frame which bound the respective frame opening. It will be further evident that the edges of the screens and substrates overlying adjacent openings of the antenna frame overlap one another. These overlapping edges are joined to one another and to the underlying antenna frame beams in the manner explained below. After the edges of the substrate and screen of each screen assembly 54 have been secured to the underlying antenna frame beams 38, the substrate and screen are cut along their edges to release the assembly support frame 46 for removal after which the substrate and screen edges are trimmed flush with the beams.

As indicated above, the overlapping edges of the net substrates 50 and screen squares 44 overlying adjacent openings 42 of the antenna frame 32 are joined to one another and to the underlying antenna frame beams 38. More specifically, the overlapping substrate and screen edges are mechanically joined to the beams and the screen edges are electrically joined to one another. This may be accomplished in various ways. According to the preferred practice of the invention, such attachment is accomplished by initially stitching external jumper wires 56 to the front walls of the antenna frame beams 38 at the front side 34 of the antenna frame 32. In this regard, it should be noted that these beams comprise two half sections 38*a* which are joined to one another along their edges to form the flanged beam shape of FIG. 2. The jumper wires are stitched into one half section prior to its attachment to the other half section to form a beam. The jumper wires of adjacent beams are electrically joined at the beam intersections by conductors 58 embodied in the coupling plates 40. The overlapping edges of the net substrates 50 are bonded in any convenient way to one another to the underlying beams 38, and the overlapping screen edges are brazed, welded, or otherwise electrically and mechanically joined to one another and to the jumper wires 56 on the underlying beams.

It will now be understood that the several screen squares 44 are electrically joined to form a parabolic reflecting screen 36. The antenna frame 32 and screen 36 may be folded to a compact collapsed configuration wherein the frame beams 38 store elastic strain energy for deploying the antenna when released to its operating configuration of FIG. 1.

We claim:

1. The method of fabricating an electrical antenna grid screen structure comprising the steps of:

stitching a substrate along intersecting rows by feeding a wire against one side of the substrate and stitching a thread through the substrate and around the wire to form a lockstitch therewith to produce on the substrate a wire grid comprising crossing wires; and electrically joining said wire at their intersections to form an electrically conductive screen.

2. The method of claim 1 wherein:

said screen is adapted to be folded for use as a foldable and deployable antenna reflector; and said substrate comprises a foldable dielectric mesh.

3. The method of claim 2 including the additional step of:

securing a disposable pattern sheet over said substrate having grid lines along which said substrate is stitched and removing said pattern sheet after stitching.

4. The method of claim 3 including the additional steps of:

prior to stitching said substrate, securing the latter about its edges to a supporting frame having a central opening spanned by the central portion of the substrate, the substrate being stitched in said grid pattern within said central portion thereof; and severing said screen and substrate from said supporting frame following stitching of the substrate in said grid pattern.

5. The method of fabricating a wire screen antenna reflector secured to a truss frame having a front side conforming substantially to a selected geometric surface, such as a parabolic surface, and constructed of truss members forming at said front side an array of openings each bounded by truss members, comprising the steps of:

securing to said frame across said frame openings individual wire screen sections; and electrically joining the several screen sections along their adjacent edges to form a wire screen reflector conforming substantially to said geometric surface.

6. The method of claim 5 including the additional steps of:

fabricating each of said screen sections by stitching a substrate along intersecting rows by feeding a wire against one side of the substrate and stitching a thread through the substrate and around the wire to form a lockstitch therewith to produce on the substrate a wire grid comprising crossing wires, and electrically joining said wires at their intersections to form an electrically conductive screen.

7. The method of claim 6 wherein:

said substrate of each screen section comprises a dielectric mesh.

8. The method of claim 7 including the additional steps of:

prior to stitching said substrate of each screen section, securing the latter about its edges to a supporting frame having a central opening larger than the corresponding frame opening and spanned by the central portion of the substrate, the substrate being stitched in said grid pattern within said central portions thereof; and severing said screen and substrate from said supporting frame following securing of the respective screen section to said truss frame.

9. The method of claim 8 including the additional steps of:

providing over said substrate of each screen section a disposable pattern having grid lines along which said substrate is stitched to form said wire grid; and removing said pattern after stitching.

10. A stitched wire screen structure comprising:

a substrate;

intersecting rows of stitching secured to said substrate in a grid pattern and each including a wire lying flat against one side of said substrate and a thread passing through the substrate and around the wire at intervals along the wire and securing the wire to the substrate with a lockstitch;

the wires of the intersecting stitch rows crossing one another; and means electrically joining said wires at their intersections.

11. A structure according to claim 10 wherein:

said substrate comprises a dielectric mesh.

12. An antenna comprising:

a truss frame constructed of elastic strain energy deformable truss members, whereby said frame may be collapsed to a compact stowage configuration and deployed by the elastic strain energy stored in said truss members;

said frame having a front side conforming to a selected surface contour such as a parabolic surface and a plurality of openings at said front side each bounded by truss members;

a plurality of separate screen sections spanning said frame openings, respectively, and secured to the surrounding truss members; and means electrically joining said screen sections along their adjacent edges.

13. An antenna according to claim 12 wherein:

each screen section comprises a foldable mesh substrate, intersecting rows of stitching secured to said substrate in a grid pattern and each including a wire lying flat against one side of said substrate and a thread passing through the substrate and around the wire at intervals along the wire and securing the wire to the substrate with a lockstitch, the wires of the intersecting stitch rows crossing one another, means electrically joining said wires at their intersections.

* * * * *